US005234511A

United States Patent [19]

LaSalle

[11] Patent Number: 5,234,511

[45] Date of Patent: Aug. 10, 1993

[54] RAPIDLY SOLIDIFIED CASE TOUGHEND ALUMINUM-LITHIUM COMPONENTS

[75] Inventor: Jerry C. LaSalle, Montclair, N.J.

[73] Assignee: Allied-Signal Inc., Morristownship, Morris County, N.J.

[21] Appl. No.: 755,430

[22] Filed: Sep. 5, 1991

Related U.S. Application Data

[62] Division of Ser. No. 502,950, Apr. 2, 1991, Pat. No. 5,045,125.

[51] Int. Cl.[5] ..... C22F 1/00

[52] U.S. Cl. ..... 148/439; 148/698; 148/700

[58] Field of Search ..... 148/439, 11.5 A, 12.7 A

[56] References Cited

U.S. PATENT DOCUMENTS

| | | | |
|---|---|---|---|
| 4,661,172 | 4/1987 | Skinner et al. | 148/12.7 A |
| 4,816,087 | 3/1989 | Cho | 148/12.7 A |
| 5,045,125 | 9/1991 | LaSalle | 148/11.5 A |
| 5,091,019 | 2/1992 | LaSalle | 148/11.5 A |

*Primary Examiner*—Upendra Roy

*Attorney, Agent, or Firm*—Ernest D. Buff; Gerhard H. Fuchs

[57] ABSTRACT

A component composed of a rapidly solidified aluminum-lithium alloy is subjected to thermal treatment at a temperature greater than 500° C. for a time period greater than 5 hours under a protective atmosphere. Thus case toughened, the component exhibits notched impact toughness from 40 to 250% greater than that exhibited prior to the thermal treatment.

6 Claims, 5 Drawing Sheets

Argon-5%Hydrogen Atmosphere

SEM Micrograph

Argon-5%Hydrogen Atmosphere

SEM Micrograph

Air Atmosphere

RAPIDLY SOLIDIFIED CASE TOUGHEND ALUMINUM-LITHIUM COMPONENTS

CROSS-REFERENCE TO RELATED APPLICATIONS

This application is a division of U.S. application Ser. No. 502,950, filed Apr. 2, 1991, now U.S. Pat. No. 5,045,125.

DESCRIPTION

1. Field of the Invention

The invention relates to rapidly solidified aluminum-lithium-copper-magnesium-zirconium alloys, and, in particular, to a process for developing enhanced toughness of finished components such as forgings.

2. Background of the Invention

Aluminum-lithium alloys are increasingly important materials for light weight high stiffness applications such as aerospace components. Rapidly solidified aluminum-lithium alloys having reduced density and improved mechanical properties are disclosed in U.S. patent application Ser. No. 478,306, filed Feb. 4, 1990. These alloys are defined by the formula $Al_{bal}Li_aCu_bMg_cZr_d$, wherein "a" ranges from about 2.6 to 3.4 wt %, "b" ranges from about 0.5 to 2.0 wt %, "c" ranges from about 0.2 to 2.0 wt % and "d" ranges from about 0.6 to 1.8 wt %, the balance being aluminum. A general characteristic of the aforementioned aluminum-lithium alloys is the heat treatment required to develop therein a microstructure necessary for optimum mechanical properties.

Forgings produced from these rapidly solidified aluminum-lithium alloys exhibit improved mechanical properties over forgings produced using conventional ingot aluminum-lithium alloys. Further improvements in the toughness of such alloys would markedly increase their applicability in aerospace structural components such as forgings, extrusions and the like.

SUMMARY OF THE INVENTION

The present invention provides a process for increasing the toughness of components formed from the aforementioned rapidly solidified aluminum-lithium alloys. Components produced in accordance with the process of the invention exhibit total toughness two to three times greater than the intrinsic toughness of components formed from untreated material, as evidenced by the notched impact toughness test. As used herein the term "total toughness" means the toughness of the component, including its extrinsic toughness, or that toughness contribution derived from modification of the component's surface chemistry. The extrinsic toughness is distinguished from the intrinsic toughness of a component, wherein the sole toughness contribution is that of the component's unmodified base alloy. While not being bound by any theory, the process of the invention is believed to produce in the components a modified surface layer which is reduced in alloying elements such as lithium and magnesium. This surface layer, being reduced in alloying constituents, is tougher than the bulk material, with the result that crack initiation therein becomes more difficult. Since crack initiation occurs at the surface of a material and consumes the bulk of the energy of failure, enhancing the surface toughness in effect enhances the toughness of the whole component.

This lithium and magnesium depleted surface layer is produced by subjecting the Al-Li alloy component to a temperature in excess of 500° C. for a time greater than 5 hours. A protective atmosphere, such as argon or argon-hydrogen, may be employed to reduce excess oxidation during the thermal treatment while still allowing reduction in surface concentration of lithium and magnesium. By this process a case toughened rapidly solidified aluminum-lithium alloy component is provided.

The aforementioned aluminum-lithium alloys previously required solutionization at temperatures of about 540° C. for periods of about 2 hrs. followed by a water quench in order to dissolve undesirable precipitates which may have formed during previous processing. In accordance with the present invention, the toughening treatment is readily carried out during conventional processing of these alloys by (1) extending the solutionization times to a time period greater than 5 hrs, and preferably greater than 10 hrs., and (2) using a protective atmosphere such as argon or argon/hydrogen to reduce excess oxidation.

BRIEF DESCRIPTION OF THE DRAWINGS

The invention will be more fully understood and further advantages will become apparent when reference is made to the following detailed description and the accompanying drawings, in which.

DESCRIPTION OF THE PREFERRED EMBODIMENTS

Generally stated, the present invention provides a process for toughening the outer layer of a rapidly solidified aluminum-lithium alloy component consisting essentially of the formula $Al_{bal}Li_aCu_bMg_cZr_d$ wherein "a" ranges from about 2.6 to 3.4 wt %, "b" ranges from about 0.5 to 2.0 wt %, "c" ranges from 0.2 to 2.0 wt % and "d" ranges from about 0.6 to 1.8 wt %, the balance being aluminum. Since a prominent initiation area for cracks is at the surface of a component, the toughened surface layer effects a significant increase in the overall toughness of the component.

Figure 1:
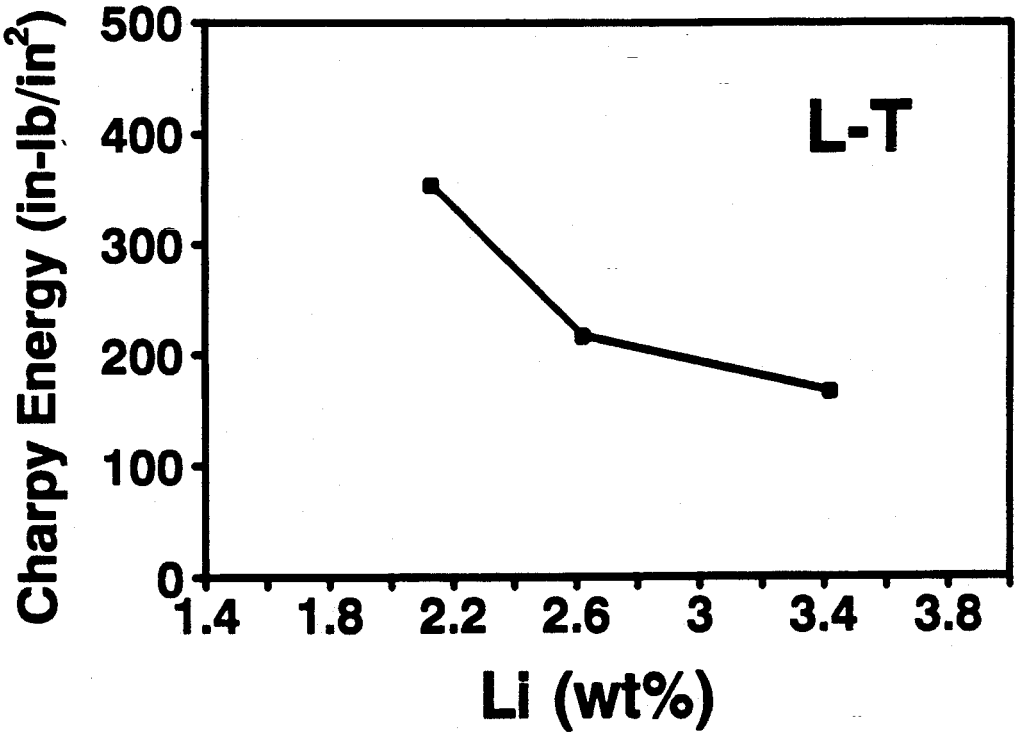
FIG. 1 is a graph illustrating the effect of increasing lithium concentration on the toughness of an Al-2.6Li-1.0Cu-0.5Mg-0.6Zr alloy solutionized for 2 hrs. at 540° C., ice water quenched and aged at 135° C. for 16 hours.

The addition of lithium to aluminum is known to result in beneficial improvements such as reduced density and increased elastic modulus. However, lithium additions to aluminum tend to reduce certain mechanical properties, particularly toughness. An example illustrating the effect of lithium on toughness is illustrated in the plot depicted by FIG. 1, which shows the notched impact energy as function of lithium content for a rapidly solidified Al-$Li_x$-1.0Cu-0.5Mg-0.6Zr alloy where x is varied from 2.1 to 3.4 wt%. This decrease in toughness with increasing lithium content limits the usefulness of aluminum-lithium alloys which are otherwise desirable due to the density and modulus improvements. Removing lithium from a component's surface while retaining high lithium concentrations in the interior thus toughens the component without reducing the bulk effects of lithium, (i.e., density reduction and modulus enhancement).

The reduction of alloying elements such as lithium and magnesium at the component's surface is obtained by heating the component to temperatures sufficient to allow fast diffusing elements such as lithium and magnesium to diffuse to the surface and evaporate. In addition, it is desirable to shield the component from excessive oxidation through the use of a protective atmosphere such as argon or argon-hydrogen mixtures. Generally, the component must be heated to a temperature in excess of 500° C., preferably from about 550° C. to 580° C. for a minimum of several hours depending on initial alloy composition, the protective atmosphere employed, and the level of toughening desired.

Temperatures below about 500° C. are insufficient to promote surface depletion of lithium and magnesium concentration, whereas temperatures above about 580° C. cause excessive grain coarsening of the parent material, resulting in degradation of mechanical properties.

The following examples are presented to provide a more complete understanding of the invention. The specific techniques, conditions, materials, proportions and reported date set forth to illustrate the principles and practice of the invention are exemplary and should not be construed as limiting the scope of the invention.

EXAMPLE 1

A rapidly solidified alloy having a composition of Al-2.6Li-1.0Cu-0.5Mg-0.6Zr was machined into notched impact specimens, solutionized at 540° C. for 17 hrs. in an argon-5% hydrogen atmosphere, quenched in ice water, and aged for 16 hrs. at 135° C. Here, excessive oxidation was prevented by the argon-5% hydrogen atmosphere. The notched impact energy for the case toughened material was 200 in-lb/$in^2$ compared with a value of 145 in-lb/$in^2$ for a specimen processed in an identical manner but having the case toughened surface layer machined away. This represents a 40% improvement in notched impact toughness.

Figure 2:
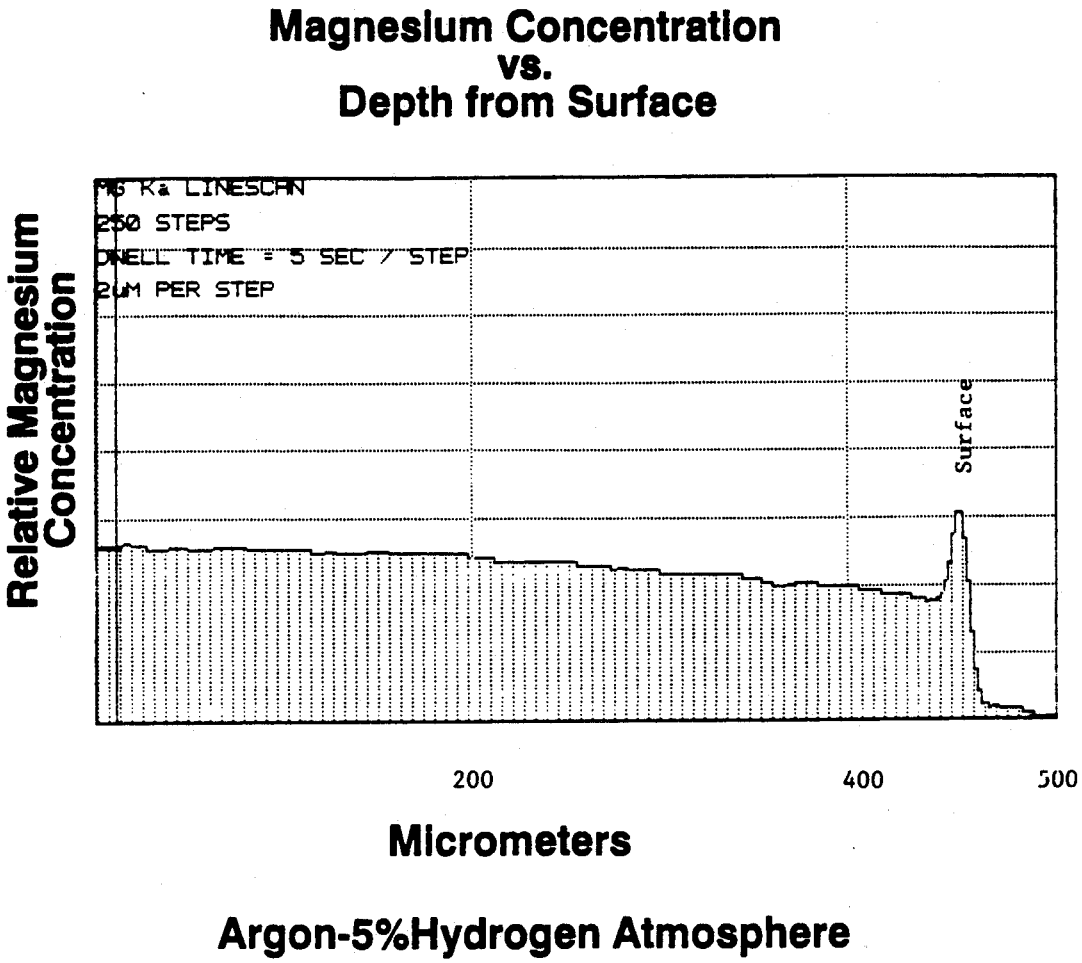
FIG. 2 is a graph depicting the magnesium profile vs. depth from the surface of a component formed from a rapidly solidified Al-2.6Li-1.0Cu-0.5Mg-0.6Zr alloy after thermal exposure to 540° C. for 17 hrs. in argon-5% hydrogen.
Figure 3:
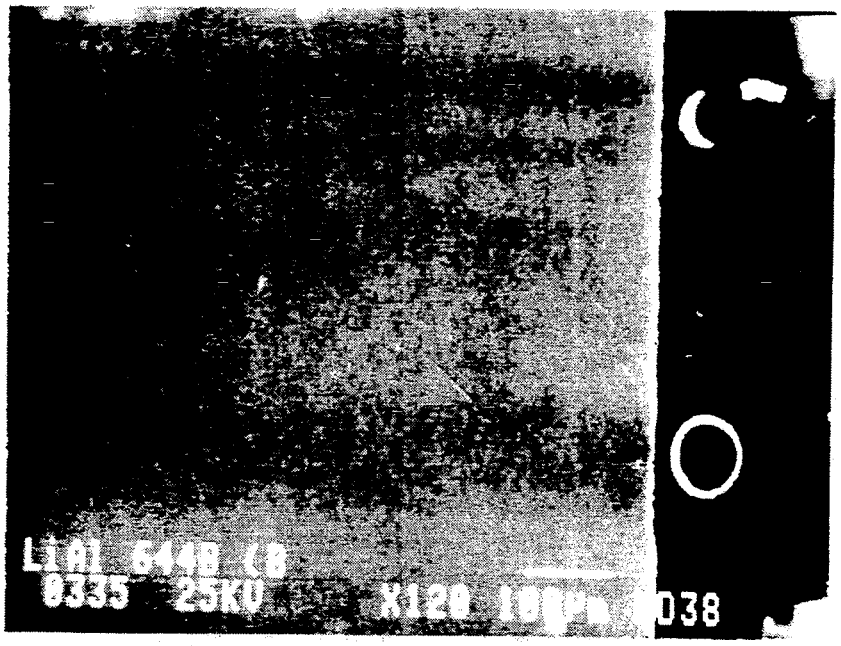
FIG. 3 is a scanning electron micrograph of the surface and substrate of a compound formed from a rapidly solidified Al-2.6Li-1.0Cu-0.5Mg-0.6Zr alloy after thermal exposure at 540° C. in argon-5% hydrogen.

A magnesium profile as a function of depth from the surface is illustrated in FIG. 2 using energy dispersive X-ray analysis in conjunction with a scanning electron microscope. The profile illustrates the reduction in magnesium at the surface resulting from the treatment described above. FIG. 3 is a scanning electron micrograph of the area analyzed in FIG. 2. The micrograph shows no porosity or oxide formation as a result of the toughening treatment.

EXAMPLE 2

A rapidly solidified alloy having a composition of Al-2.6Li-1.0Cu-0.5Mg-0.6Zr was machined into notched impact specimens, solutionized at 540° C. for 17 hrs. in an argon atmosphere, quenched in ice water, and aged for 16 hrs. at 135° C. Here, the normal thermal treatment for this alloy was varied by extending the normal solutionization time of about 2 hrs. to a solutionization time of about 17 hrs., allowing lithium and magnesium to diffuse from the surface while excessive oxidation was prevented by the argon atmosphere. The notched impact energy for the case toughened material was 260 in-lb/$in^2$ compared with a value of 145 in-lb/$in^2$ for a specimen processed in an identical manner but having the case toughened surface layer machined away. This represents an 80% improvement in notched impact toughness.

EXAMPLE 3

A rapidly solidified alloy having a composition of Al-2.6Li-1.0Cu-0.5Mg-0.6Zr was machined into notched impact specimens, solutionized at 540° C. for 2 hrs. in air, quenched in ice water, and aged for 16 hrs. at 135° C. The notched impact energy for the case toughened material was 455 in-lb/$in^2$ compared with a value of 145 in-lb/$in^2$ for a specimen processed in an identical manner but having the case toughened surface layer machined away. This represents a 214% improvement in notched impact toughness.

Figure 4:
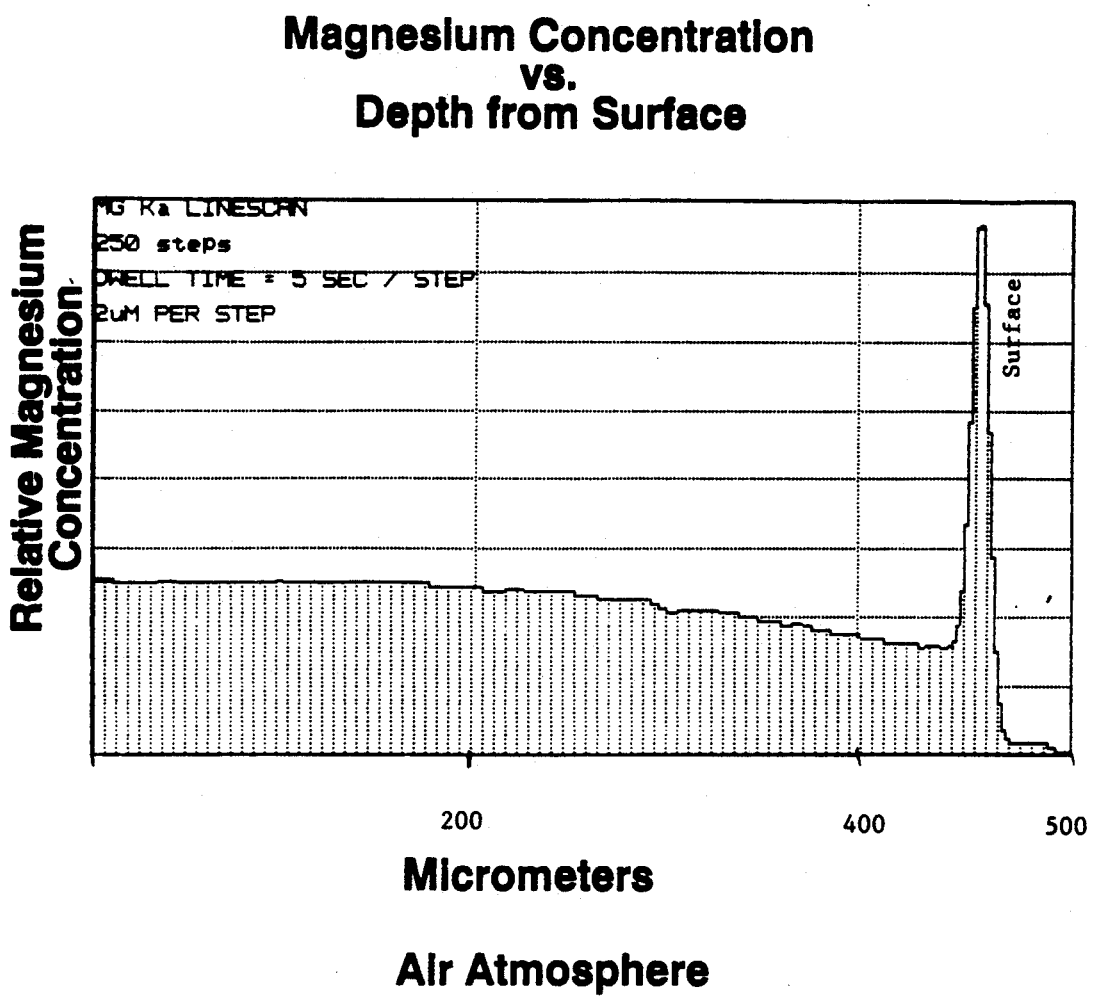
FIG. 4 is a graph depicting the magnesium profile vs. depth from the surface of a component formed from a rapidly solidified Al-2.6Li-1.0Cu-0.5Mg-0.6Zr alloy after thermal exposure at 540° C. for 2 hrs. in air.
Figure 5:
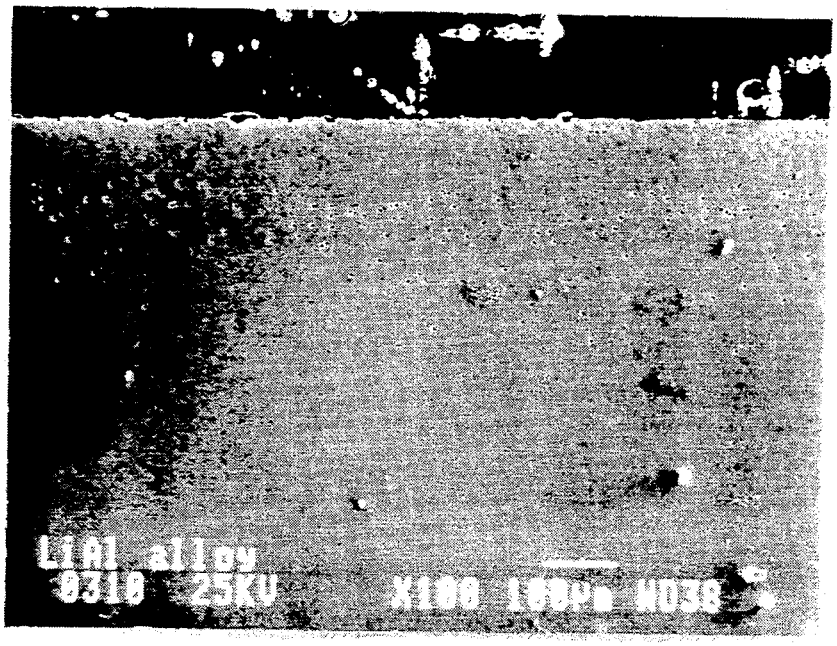
FIG. 5 is a scanning electron micrograph of the surface and substrate of a component formed from a rapidly solidified Al-2.6Li-1.0Cu-0.5Mg-0.6Zr alloy after thermal exposure at 540° C. for 2 hrs. in air.

A magnesium profile as function of depth from the surface is illustrated in FIG. 4 using energy dispersive X-ray analysis in conjunction with a scanning electron microscope. The profile illustrates the reduction in magnesium at the surface resulting from the treatment described above and a large peak at the surface indicating excessive formation of magnesium oxide.. FIG. 5 is a scanning electron micrograph of the area analyzed in FIG. 4. The micrograph shows porosity due to oxide formation resulting from the lack of protective atmosphere.

Having thus described the invention in rather full detail, it will be understood that such detail need not be strictly adhered to but that further changes may suggest themselves to one having ordinary skill in the art, all falling within the scope of the invention as defined by the subjoined claims.

What is claimed:

1. An aluminum-lithium component formed from a rapidly solidified aluminum-lithium alloy consisting essentially of the formula $Al_{bal}Li_aCu_bMg_cZr_d$ wherein "a" ranges from about 2.6 to 3.4 wt %, "b" ranges from about 0.5 to 2.0 wt %, "c" ranges from about 0.2 to 2.0 wt % and "d" ranges from about 0.6 to 1.8 wt %, the balance being aluminum, said component having been subjected to a thermal treatment at a temperature greater than 500° C. for a time period greater than 10 hrs. under a protective atmosphere.

2. A component as recited by claim 1, having a notched impact toughness from 40 to 250% greater than that prior to said thermal treatment.

3. A component as recited by claim 1, wherein said alloy has the composition 2.6 wt % lithium, 1.0 wt % copper, 0.5 wt % magnesium and 0.6 wt % zirconium, the balance being aluminum.

4. A component as recited by claim 1, wherein said temperature ranges from about 540° C. to 580° C.

5. A component as recited by claim 1, wherein said protective atmosphere is composed of argon or mixtures thereof with hydrogen.

6. A component as recited by claim 1 said component having a total toughness greater than the intrinsic toughness thereof prior to said thermal treatment.

* * * * *